US005609502A

United States Patent [19]

Thumma

[11] Patent Number: 5,609,502

[45] Date of Patent: Mar. 11, 1997

[54] CONTACT RETENTION SYSTEM

[75] Inventor: Mark R. Thumma, Oberlin, Pa.

[73] Assignee: The Whitaker Corporation, Wilmington, Del.

[21] Appl. No.: 414,260

[22] Filed: Mar. 31, 1995

[51] Int. Cl.[6] ..... H01R 13/432

[52] U.S. Cl. ..... 439/747; 439/733.1; 439/746; 439/748; 439/749

[58] Field of Search ..... 439/637, 62, 182, 439/733.1, 746, 747, 748, 749

[56] References Cited

U.S. PATENT DOCUMENTS

| | | | |
|---|---|---|---|
| 3,601,775 | 8/1971 | Longenecker et al. | 439/748 |
| 4,184,735 | 1/1980 | Ammon et al. | 339/217 S |
| 4,274,699 | 6/1981 | Keim | 439/733.1 |
| 4,288,139 | 9/1981 | Cobaugh et al. | 339/74 R |
| 4,396,245 | 8/1983 | Lane | 339/38 |
| 4,832,614 | 5/1989 | Jenkins | 439/188 |
| 5,137,454 | 8/1992 | Baechtle | 439/62 |

FOREIGN PATENT DOCUMENTS

| | | | |
|---|---|---|---|
| 74884 | 6/1977 | Japan | 439/637 |
| 1317394 | 5/1973 | United Kingdom | 439/637 |

*Primary Examiner*—P. Austin Bradley
*Assistant Examiner*—Eugene G. Byrd
*Attorney, Agent, or Firm*—Katherine A. Nelson

[57] ABSTRACT

A contact retention system using a self-seating contact (56) includes a housing (22) having at least one contact receiving passageway (30) and a contact (56) associated therewith. Contact (56) has leading and trailing end portions (62, 80) and an intermediate body portion (66). Body portion (66) has a dimension wider than end portions (62, 80) and defines forwardly facing and rearwardly facing latch surfaces (76, 74). Each of opposed passageway side surfaces (36, 42) has a latching projection (38, 44) extending toward the other passageway side surface (44, 38) defining forwardly and rearwardly facing stop surfaces (40, 46) offset from at least one edge (74, 76) of the contact (56) and axially spaced at a slightly greater length that the length of the body portion (66). Upon inserting leading end portion (62) into passageway (30), portion (62) encounters the first latching projection (38) so that trailing end portion (80) is constrained to urge the contact (56) against projection (38) until full insertion thereafter the latch seats and body portion (66) is disposed between the two latch projections (38, 44) and is self-seating in the passageway (30).

4 Claims, 5 Drawing Sheets

CONTACT RETENTION SYSTEM

FIELD OF THE INVENTION

The present invention is directed to electrical connectors and more particularly to a contact retention system for electrical connectors.

BACKGROUND OF THE INVENTION

In assembling connectors it is important to provide a structure within the housing or include a device to retain the contacts in the housing. The various ways of retaining the contacts include providing an interference fit within contact receiving passageways of a housing, using outwardly projecting lances on the contacts which abut an internal surface within the passageway or use of a secondary step in manufacturing, such as staking, use of a tool and a high force latch or the like. For cost effective manufacturing, however, it is desirable to eliminate the need for post assembly operations and rely on the structure of the housing and/or contacts to hold the contacts in the housing.

The problems associated with contact retention are exacerbated when the contacts are loaded into a connector from the mating face thereof and the connector is then mounted to a circuit board or the like. One method of preventing contacts from moving outwardly from the connector is by the use of a tool or removable cover to hold the contacts in place while force is applied to mount the connector to a board, such as disclosed in U.S. Pat. No. 4,396,245. In other cases a secondary manufacturing step, such as using a tool to provide a wall engaging lance in the contact (See FIGS. 11 and 12) is employed after the contacts are inserted into the housing.

SUMMARY OF THE INVENTION

A contact retention system using a self-seating contact includes a housing having at least one contact receiving passageway extending from an assembly face to a connecting face and a contact associated with the passageway, and insertable into the passageway from the assembly face. The contact has a selected thickness, opposed side surfaces and opposed edges, and leading and trailing end portions of selected widths. The leading end includes a connecting section. The contact further has a body portion intermediate the leading and trailing end portions to be disposed along a portion of the passageway upon full contact insertion. The contact body portion has a dimension wider than the leading and trailing end portions. A section of the contact body portion extends laterally outwardly from at least one edge of the contact and defines at least one forwardly facing latch surface and at least one rearwardly facing latch surface. The housing passageway portion includes first and second opposed side surfaces associated with the side surfaces of the contact. A first passageway side surface has at least one first latching projection extending toward a second passageway side surface and defines a forwardly facing stop surface associated with the rearwardly facing latch surface on the contact. The second passageway side surface has at least one second latch projection extending toward the first passageway side surface and defines a rearwardly facing stop surface associated with the forward facing latch surface of the contact. The first and second latch projections are offset from the edges of trailing and leading end portions of the contact and axially spaced from each other a distance slightly greater than the length of the body portion. The housing includes a biasing surface proximate the assembly face and opposed from the first passageway side surface, and the contact includes a biasing portion along the trailing end portion engageable with the biasing surface prior to full contact insertion. The biasing surface urges the body portion against the first projection along the first passageway side surface until the body portion passes the projection. Upon inserting the leading end of the contact into the passageway from the assembly face of the housing, the leading end encounters the first latching projection so that the trailing end of the contact is constrained to urge the contact against the first latching projection until full insertion thereafter the latch seats. The wide body portion is thereby disposed between the two latch projections upon being seated in the housing and is self latching in the passageway portion.

In the preferred embodiment the body portion has a section thereof that extends outwardly from both side edges of the contact defining two forwardly facing latch surfaces and two rearwardly facing latch surfaces. The passageway in the housing includes two rearwardly and two forwardly facing stop surfaces that engage the respective latch surfaces on the contact.

In an alternative embodiment the second latch projection is spaced from side surface a distance less that the thickness of the contact and defines a constriction along the connecting face.

The contact retention system of the present invention has a relatively low insertion force thereby allowing multiple contacts, such as in a strip of contacts, to be inserted in the housing simultaneously.

Embodiments of the invention will now be described by way of example with reference to the accompanying drawings.

BRIEF DESCRIPTION OF THE DRAWINGS

FIG. 3 is a enlarged fragmentary sectional view of the contact passageway portion with the contact removed there from.

DETAILED DESCRIPTION OF THE INVENTION

For purposes of illustrating the invention connector 20 is shown as a card edge style connector having contacts 56 with spring arms portions that are prestressed during insertion. It is to be understood that other types of connectors such as those having contacts having spring portions that are anchored in the housing, known in the art as having a "preloaded contact spring or stress" applied during the insertion of the contacts into respective housing passageways. It is to be understood that this retention system and self-seating contact structure may be used with connectors other than card edge connectors.

Figure 1:
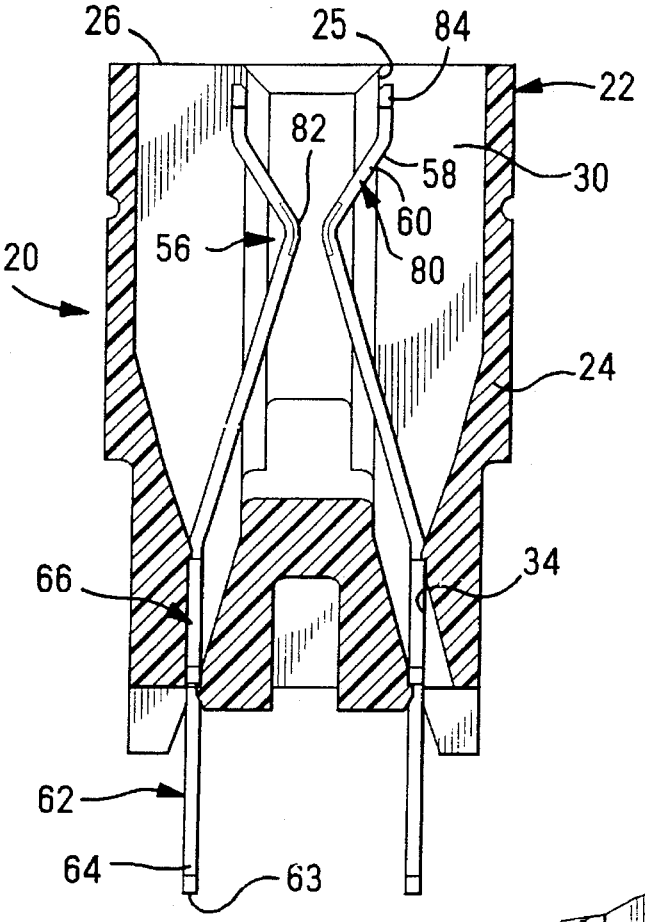
FIG. 1 is a cross sectional view of an electrical connector having the contact retention system of the present invention.
Figure 2:
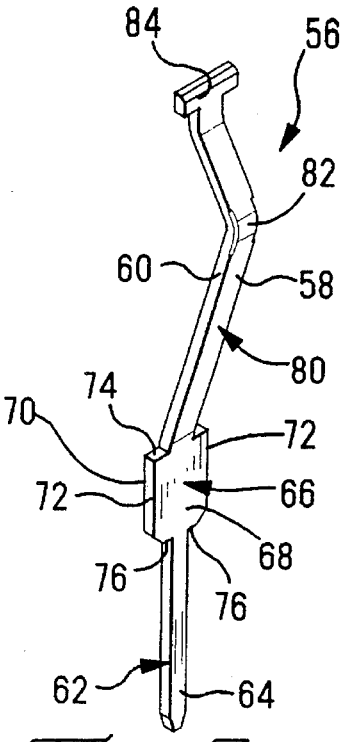
FIG. 2 is a isometric view of the contact used in the connector of FIG. 1.
Figure 3:
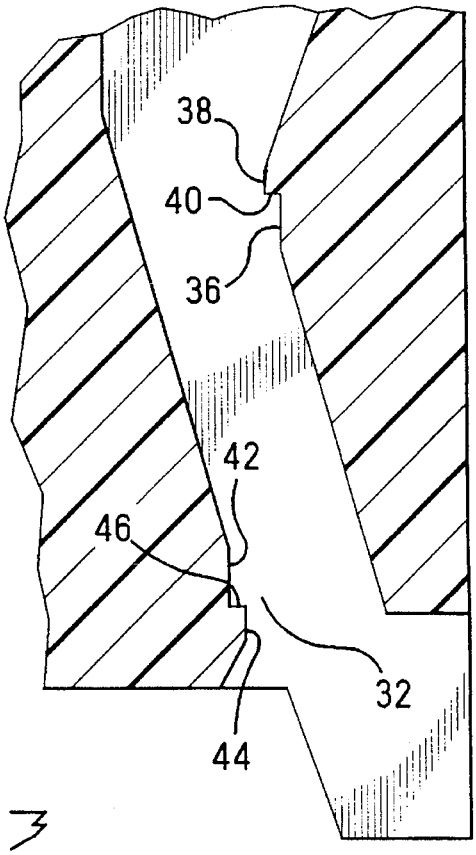
Figure 4:
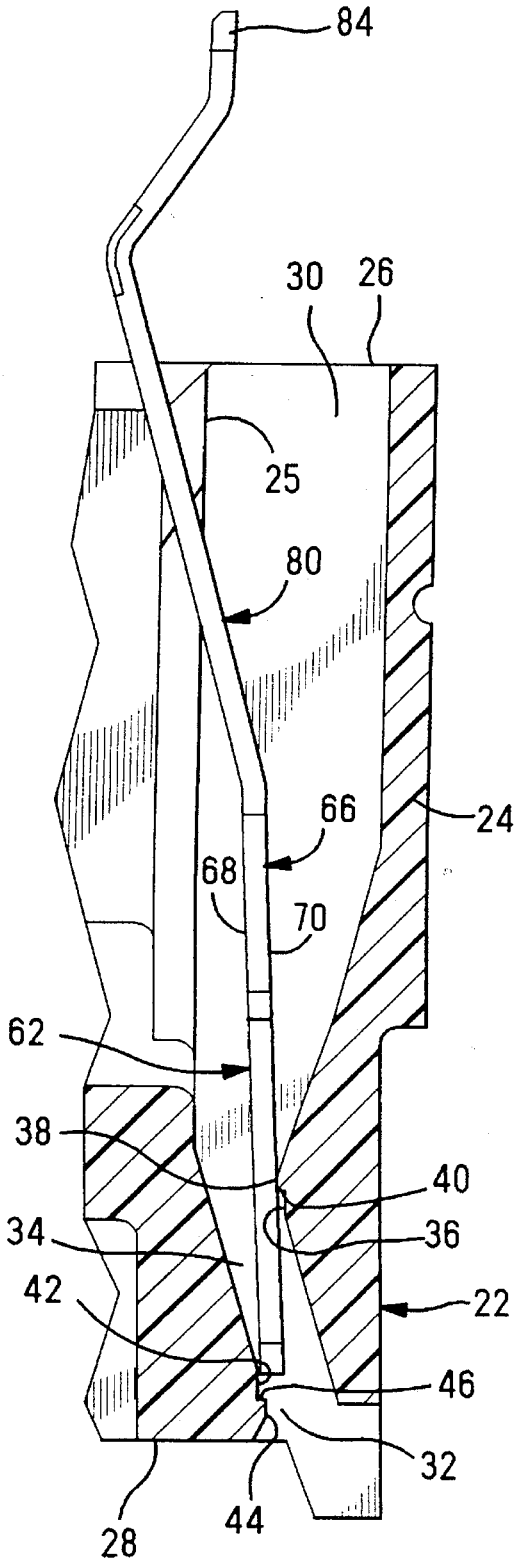
FIGS. 4 through 7 illustrate the sequential insertion of the contact of FIG. 2 into the connector of FIG. 1 with the contact in FIG. 7 being shown fully inserted.
Figure 5:
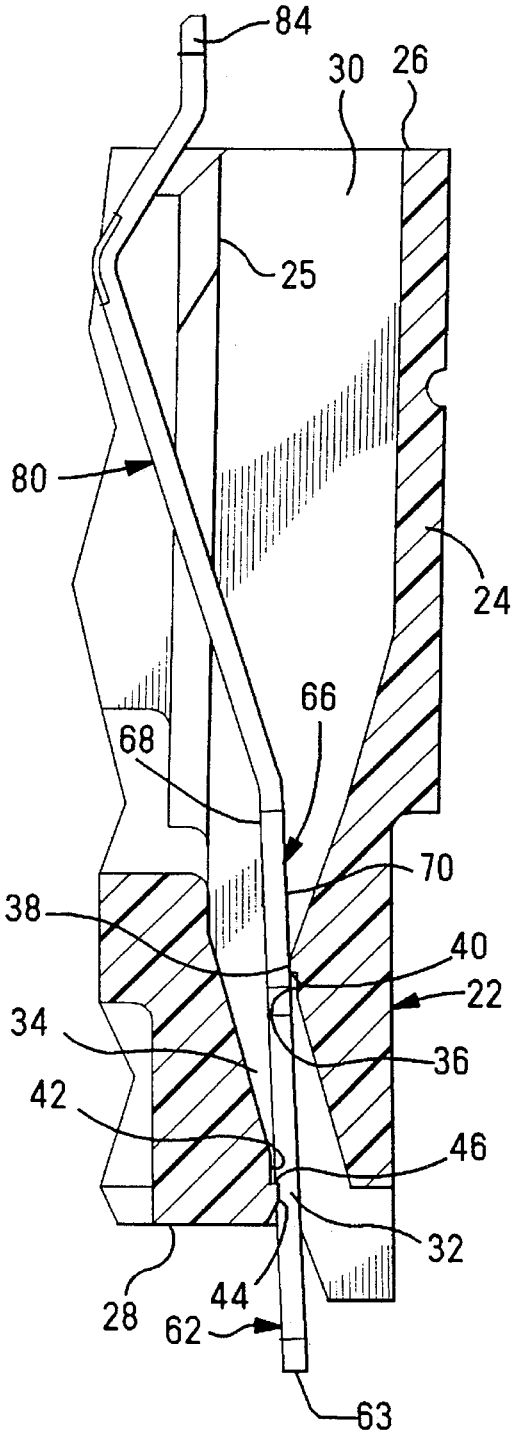
Figure 6:
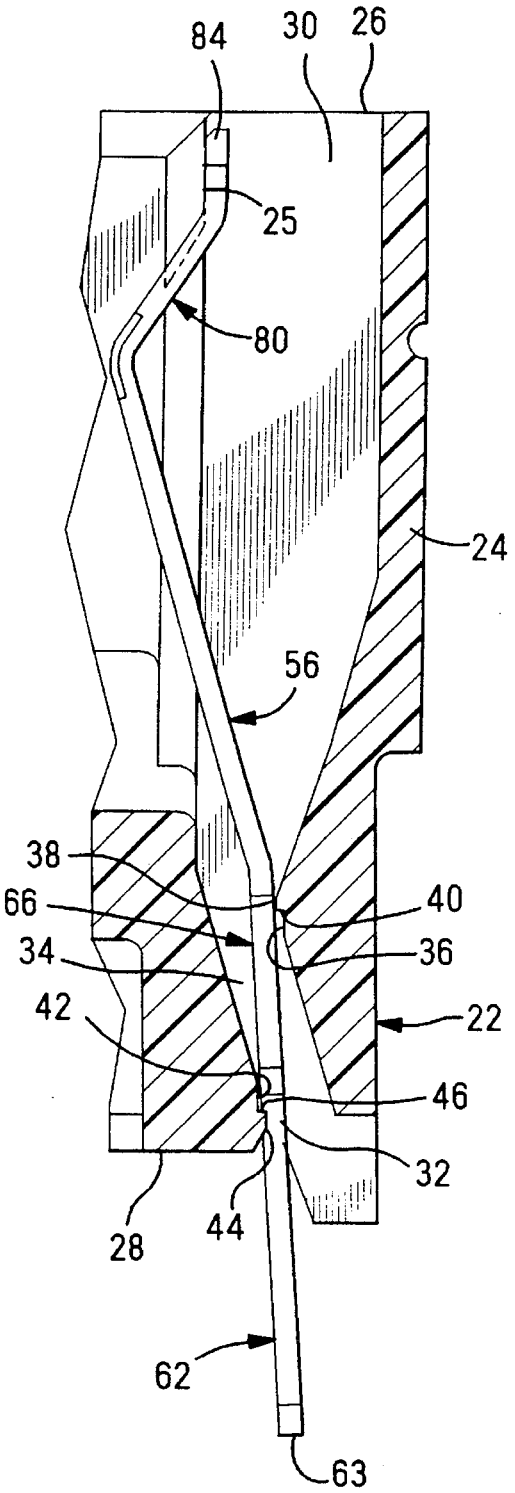

FIGS. 1, 2 and 3 illustrate a connector 20 made in accordance with the present invention. Connector 20 includes a housing 22 having a plurality of contacts 56 disposed within respective contact receiving passageways 30 thereof. Housing 22 includes sidewalls 24, assembly face 26, and connecting face 28. Contact receiving passageways 30 extend from the assembly face 26 to the connecting face 28 and include a passageway portion 34 having first and second opposed side surfaces 36, 42 associated with side surfaces 70, 68 of the contact 56 disposed therein. One side surface 36 of each contact receiving passageway 30 includes at least one latching projection 38 extending toward the second passageway side surface 42 defining a forwardly facing stop surface 40 cooperable with a rearwardly facing latch surface 74 on the contact 56. As seen in FIG. 3, the latching projection 38 is at the innermost end of passageway portion 34. The second passageway side surface 42 has at least one second latching projection 44 extending toward the first passageway side surface 36 and defining a rearwardly facing stop surface 46 associated with a forwardly facing latch surface 76 of the contact 56. Contact 56 has opposed side surfaces 58, opposed edges 60 and a selected width. Contact 56 includes a leading end portion 62, a trailing end portion 80 and a intermediate body portion 66. In the embodiment shown, leading end portion 62 includes a connecting section 64 for insertion into through holes of a circuit board (not shown) and trailing end portion 80 includes a contact section 82 for engaging circuit pads on a circuit board (not shown). Intermediate body portion 66 is adapted to be disposed along passageway portion 34 upon full insertion of contact 56 into the housing passageway 30. Intermediate body portion 66 is a generally flat member having opposed body surfaces 68, 70, opposed side edges 72, and opposed end edges 74 and 76. The contact body portion 66 has a dimension wider than the leading and trailing end portions 62, 80 and extends laterally outwardly from at least one edge 60 and define at least one forwardly facing latch surface 76 and at least one rearwardly facing latch surface 74. Preferably body portion 66 extends outwardly from both side edges 60 of contact 56 and define two forwardly facing and two rearwardly facing latch surfaces 76, 74 respectively.

As can be seen in FIG. 1 the free end 84 of trailing end portion 80 is adapted to be captured behind an internal wall or barrier 25 within the connector housing 22 thereby pre-stressing the spring arm leading end portion 80 with the contact section 82 extending into the cavity proximate the assembly or mating face 26 for mating with pads on a circuit board (not shown).

Figure 7:
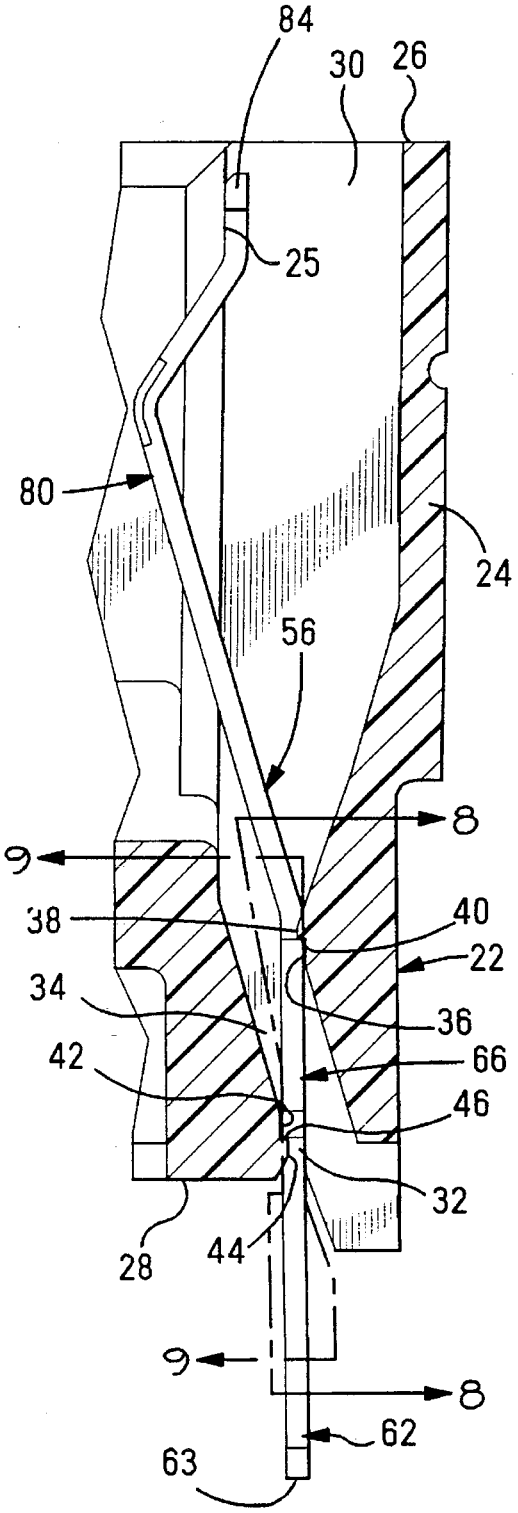

Referring now to FIGS. 4 through 7, contact 56 is inserted into contact receiving passageway 30 from the assembly face 26 of housing 22 with the free end 63 of the leading end portion 62 moving along the surface of projection 38 and exiting passageway opening 32 as the contact 56 is moved into passageway 30. Surface 70 of intermediate body portion 66 engages the surface of projection 38 along the first passageway side surface 36 and moves therealong until the body portion 66 passes projection 38. As contact 56 is moved further into the housing the free end 84 of trailing end portion 80 approaches the assembly face 26. The free end 84 of the trailing end portion 80 is then pulled behind the preload barrier 25 within housing 22. The resulting force on contact 56 causes contact 56 to pivot about the surface of projection 38. After the free end 84 is moved behind the barrier 25, contact 56 is moved further into the passageway 30 and contact body surface 70 continues to move along the first projection 38 until it reaches the end edge or rearwardly facing latch surface 74 whereupon forwardly facing stop surface 40 of projection 38 latches over rearwardly facing latch surface 74. This causes the body portion 66 of the contact 56 to spring toward passageway side surface 42 such that upon full seating of the contact 56 the forwardly facing latch surface 76 engages rearwardly facing stop surface 46 on second projection 44 as best seen in FIGS. 7, 8 and 9 thereby snapping the flat body portion 66 into engagement between the two latching projections 38, 42 and securing the contact 56 in the passageway portion 34.

Figure 9:
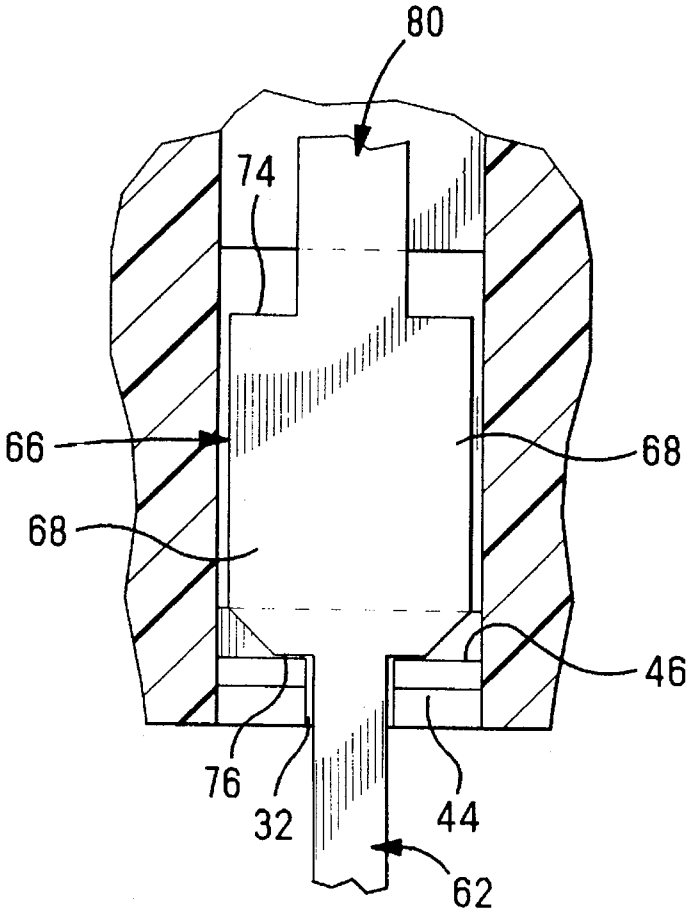
FIG. 9 is a sectional view taken along the line 9—9 of FIG. 7.
Figure 8:
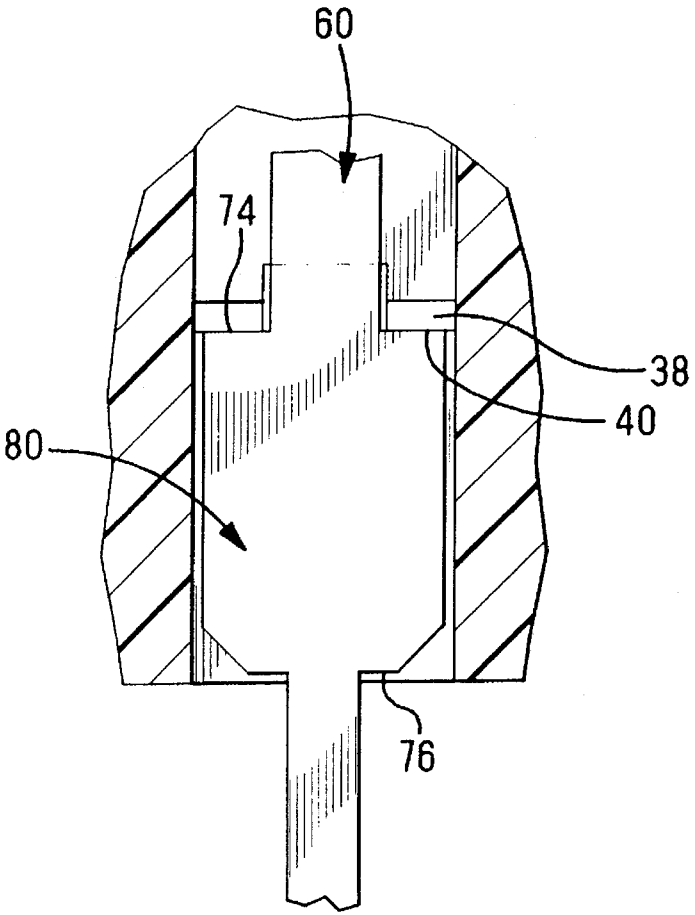
FIG. 8 is a cross sectional view taken along line 8—8 of FIG. 7.

In the preferred embodiment the first and second latch projections 38, 44 of the housing sidewalls 36, 42 engage outwardly extending latch surfaces 74, 76 of the intermediate body portion 66 at two locations, one along each edge of the contact 56 as shown in FIGS. 8 and 9. The forces generated by the preloaded contact cause contact 56 to be self-seating, that is it is secured from axial movement in either direction and needs no further staking, or use of a high force preformed latch. The stop surfaces 40, 46 on the two projections 38, 44 respectively are spaced axially apart a distance slightly greater than the distance between the opposed latch surfaces 74, 76 of body portion 66 and keep the contact 56 from moving downwardly in the housing passageway 30 or upwardly in housing passageway 30 once the contact has been fully seated. The self-seating or latching feature of the present invention enables the connector 20 to be assembled with a minimum number of manufacturing processes, thereby making it more cost effective to manufacture than the prior art connector 120 shown in FIGS. 11 and 12. Additionally the contact retention system of the present invention requires less insertion force in disposing the contacts in the housing cavities, thereby permitting mass insertion of the contacts, such as for example, contacts extending from a carrier strip. After inserting the contacts into the respective passageways the carrier strip is removed.

Figure 10:
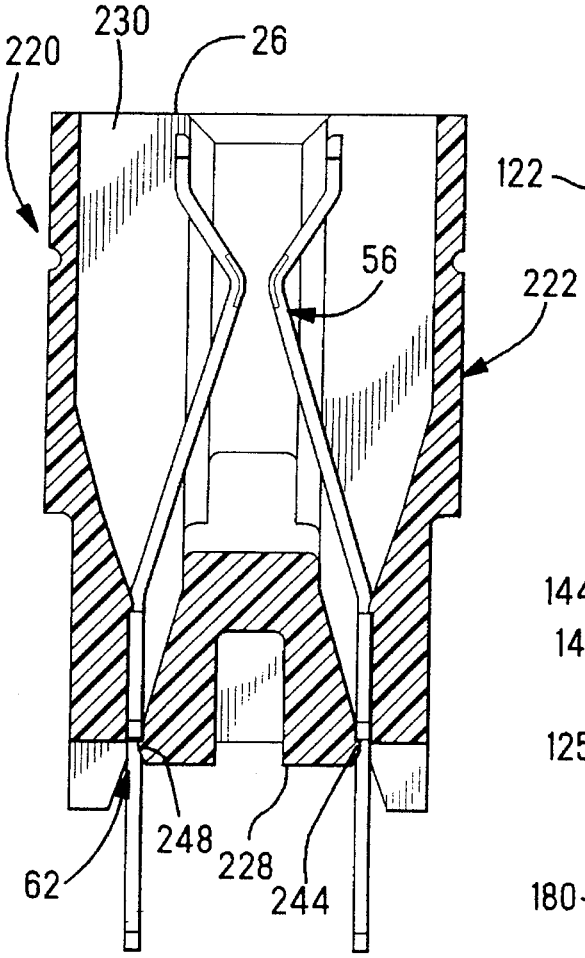
FIG. 10 is an alternative embodiment of the contact retention system of the present invention.

FIG. 10 shows an alternative embodiment 220 of a connector made in accordance with the present invention. The housing 222 includes an assembly face 226, connecting face 228 and contact receiving cavities 230. The leading end portion 62 of contact 56 has a selected width and the second latch projection 244 of the passageway 230 is spaced from the other passageway side surface a distance less than the thickness of the contact 56 and defines a constriction 248 proximate the opening along the connecting face 228.

Figure 11:
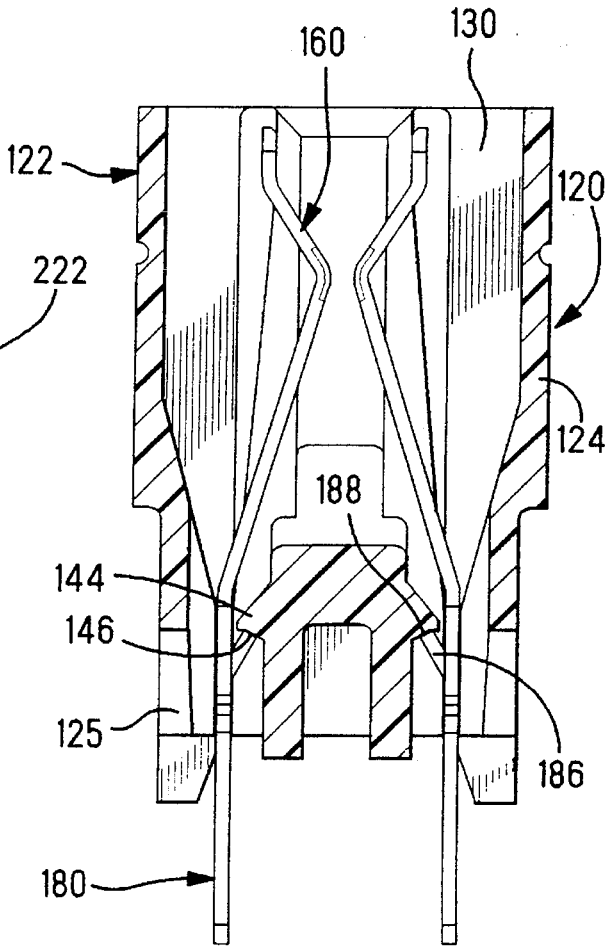
Fig. 11 PRIOR ART
FIG. 11 is a cross sectional view of a prior art connector.
Figure 12:
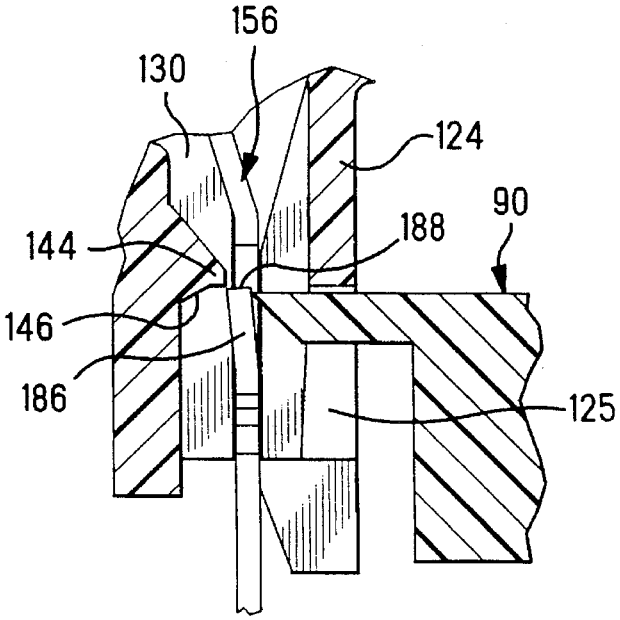
PRIOR ART Fig. 12
FIG. 12 is an enlarged fragmentary portion of the connector of the of FIG. 10 and a tool being used to latch the contact in place.

As can be seen in FIGS. 11 and 12 the prior art connector 120 includes a housing 122 and contacts 156. The housing sidewalls 124 include an opening 125 at the lower edge thereof for receiving a tool 90 inserted into the contact passageway 130 to move a lance 186 in the contact after the contact has been fully inserted into the housing 122. The latching surface 188 on the leading end 180 of the contact 56 engages a stop surface 144 on a inner wall 146 of housing 122.

The present invention, on the other hand, provides a self latching contact that is retained within the housing without resorting to the use of high force devices to stake plastic or metal or to drive the contacts into an interference fit within the housing. Furthermore, no special tool is needed to prevent the contacts 56 from moving toward the mating or assembly face 26 and outwardly of the housing passageways 30 during mounting of the connector 20 to a circuit board.

The contact of the present invention is preferably stamped and form from metal such as phosphor bronze or other metals having the desired spring characteristics. The housing is made of material of dielectric materials such as polyesters or other suitable materials as known in the art.

It is thought that the contact retention system using a self-seating contact of the present invention and many of its attendant advantages will be understood from the foregoing description. It is apparent that various changes may be made in the form, construction, and arrangement of parts thereof without departing from the spirit or scope of the invention, or sacrificing all of its material advantages.

What is claimed is:

1. A contact retention system using a self-seating contact comprising:

a housing having at least one contact receiving passageway extending from an assembly face to a connecting face;

a contact associated with said passageway, and insertable thereinto from said assembly face, said contact having opposed side surfaces and opposed edges, and leading and trailing end portions of selected widths, said contact further having a body portion intermediate said leading and trailing end portions to be disposed along a portion of said passageway upon full contact insertion, said contact body portion having a dimension wider than said leading and trailing end portions and extending laterally outwardly from at least one said edge of said contact and defining at least one forwardly facing latch surface and at least one rearwardly facing latch surface;

said housing passageway portion having opposed first and second side surfaces associated with said side surfaces of said contact, said first passageway side surface having at least one first latching projection extending toward said second passageway side surface and defining a forwardly facing stop surface associated with said rearwardly facing latch surface on said contact, said second passageway side surface having at least one second latch projection extending toward said first passageway side surface and defining a rearwardly facing stop surface associated with said forward facing latch surface of said contact, said first and second latch projections being offset from said edges of trailing and leading end portions of said contact and axially spaced from each other a distance slightly greater than the length of said body portion;

said housing including a biasing surface proximate said assembly face and opposed from said first passageway side surface, and said contact including a biasing portion along said trailing end portion engageable with said biasing surface prior to full contact insertion, urging said body portion against said first projection along said first passageway side surface until said body portion passes said projection;

whereby upon inserting said leading end portion of said contact into said passageway from the assembly face of said housing, said leading end portion encounters said first latching projection so that said trailing end portion of said contact is constrained to urge said contact against said first latching projection until full insertion thereafter said latch seats, whereafter said wide body portion is disposed between said first and second latch projections upon being fully inserted in said housing and is self-seating in said passageway portion.

2. The contact retention system of claim 1 wherein said contact has a contact body portion extending laterally outwardly from each of said opposed edges of said contact defining two forwardly facing latch surfaces and two rearwardly facing latch surfaces and said housing passageway has two first latching projections defining two forwardly facing stop surfaces on said first passageway side surface and two second latching projections defining two rearwardly facing stop surfaces on said second passageway side surface.

3. The contact retention system of claim 1 wherein said contact has a selected thickness and said second latch projection is spaced from said housing side surface a distance less that the thickness of said contact thereby defining a constriction along said connecting face.

4. A contact retention system with a self-seating contact, comprising:

a housing including at least one contact receiving passageway having opposed side surfaces; and a contact associated therewith having leading and trailing end portions and an intermediate body portion having a selected length and width, said width being of a dimension wider than that of said end portions, said body portion defining forwardly facing and rearwardly facing latch surfaces;

each said side surface of said passageway having a latching projection extending toward the other passageway side surface defining forwardly and rearwardly facing stop surfaces offset from at least one latch surface of said contact and axially spaced at a slightly greater length then the length of the body portion;

whereby upon inserting said leading end portion of said contact into said passageway from the assembly face of said housing, said leading end portion encounters said first latching projection so that said trailing end portion of said contact is constrained to urge said contact against said first latching projection until full insertion thereafter said latch seats, whereafter said wide body portion is retained between said two latch projections upon being fully inserted in said housing and is self-seating in said passageway portion.

* * * * *